US011647855B2

(12) United States Patent
Talabot

(10) Patent No.: US 11,647,855 B2
(45) Date of Patent: May 16, 2023

(54) BEVERAGE DISPENSING DEVICE

(71) Applicant: William Paul Talabot, Tulle (FR)

(72) Inventor: William Paul Talabot, Tulle (FR)

( * ) Notice: Subject to any disclaimer, the term of this patent is extended or adjusted under 35 U.S.C. 154(b) by 208 days.

(21) Appl. No.: 17/306,297

(22) Filed: May 3, 2021

(65) Prior Publication Data

US 2021/0345801 A1 Nov. 11, 2021

(30) Foreign Application Priority Data

May 5, 2020 (FR) ..... 2004465

(51) Int. Cl.

| | |
|---|---|
| ***A47G 19/22*** | (2006.01) |
| ***A47G 19/12*** | (2006.01) |
| ***B65D 25/04*** | (2006.01) |
| ***B65D 47/06*** | (2006.01) |

(52) U.S. Cl.

CPC ..... *A47G 19/2272* (2013.01); *A47G 19/12* (2013.01); *B65D 25/04* (2013.01); *B65D 47/06* (2013.01); *A47G 2019/122* (2013.01)

(58) Field of Classification Search

CPC ..... A47G 19/12; A47G 19/2266; A47G 19/2272; A47G 2019/122; B65D 25/04; B65D 47/06

See application file for complete search history.

(56) References Cited

U.S. PATENT DOCUMENTS

| | | | | |
|---|---|---|---|---|
| 3,558,033 | A * | 1/1971 | Leeds | B65D 77/283 220/710 |
| 2005/0274722 | A1* | 12/2005 | Vilchez, Jr. | A47G 19/2227 220/4.27 |
| 2013/0150783 | A1 | 6/2013 | Pamboukis | |
| 2013/0240545 | A1* | 9/2013 | O'Sullivan | A47G 19/2222 220/710 |
| 2014/0186507 | A1* | 7/2014 | Wales | A23L 2/00 426/519 |
| 2020/0008604 | A1* | 1/2020 | Fontier | A47G 19/2272 |

FOREIGN PATENT DOCUMENTS

| | | |
|---|---|---|
| WO | 2018/234275 | 12/2018 |

OTHER PUBLICATIONS

Search Report and Written Opinion issued in French Patent Application No. 2004465, 6 pages.

* cited by examiner

*Primary Examiner* — J C Jacyna
(74) *Attorney, Agent, or Firm* — Nixon & Vanderhye

(57) ABSTRACT

Disclosed is a beverage dispensing device, characterized in that it includes a main container, including a beverage receiving cavity and a fluid suction nozzle, a secondary container adapted to be movable inside the beverage receiving cavity, including at least one hole, a component providing a communication between the secondary container and the main container, configured such that, when the secondary container is in the beverage receiving cavity, between an upper position and an open position, the at least one hole is plugged, and between the open position and a lower position, the at least one hole is not plugged.

20 Claims, 8 Drawing Sheets

BEVERAGE DISPENSING DEVICE

This application claims priority to FR Application No. 2004465 filed 5 May 2020, the entire contents of which is hereby incorporated by reference.

BACKGROUND OF THE INVENTION

Field of the Invention

The present invention relates to the field of beverage dispensing devices, and more particularly concerns a beverage dispensing device for successively dispensing two beverages.

Description of the Related Art

In a context of the fight against pathologies such as obesity and diabetes, there are beverage dispensing devices configured to reduce the consumption of sugar or flavor enhancers while guaranteeing an equivalent taste sensation. For example, a liquid dispensing apparatus is known from international PCT application WO2018/234275 A1 that allows for the alternating suction of two types of beverages from two containers, one of which contains a flavor enhancer absent from the second or present in a relatively different amount.

However, such devices do not guarantee accurate dosing and in particular are not user-friendly to fill.

There is therefore a need for a beverage dispensing device that is accurate and easy to use.

The Applicant therefore proposes to meet this need by using a beverage dispensing device comprising two containers, one of which is movable relative to the other, each comprising a beverage, and equipped with closure control means, so as to control the dispensing of the beverage from the second container in such a way as to allow for the successive dispensing of two beverages without mixing.

SUMMARY OF THE INVENTION

The object of the present invention is therefore a beverage dispensing device, characterized in that it comprises a main container, comprising a bottom and a side wall extending from the bottom towards an upper face, a beverage receiving cavity being formed in the main container, extending from the bottom and opening onto the upper face, the bottom of the beverage receiving cavity communicating with a channel circulating in the main container, the channel providing a communication between the bottom of the beverage receiving cavity and a fluid suction nozzle protruding from the upper face of the main container to enable a user to suck fluid contained in the beverage receiving cavity of the main container through the suction nozzle, a secondary container adapted to be movable within the beverage receiving cavity of the main container, the secondary container comprising a beverage receiving cavity opening on an upper face of the secondary container, at least one hole being formed in the bottom of the beverage receiving cavity of the secondary container, the beverage dispensing device comprising communication providing means between the interior of the beverage receiving cavity of the secondary container and the interior of the beverage receiving cavity of the main container and the channel of the main container, said communication providing means being configured so that when the secondary container is in the beverage receiving cavity of the main container, between an upper position of the secondary container and an open position of the secondary container, the at least one hole formed in the bottom of the beverage receiving cavity of the secondary container is plugged, and between the open position and a lower position of the secondary container in which the secondary container touches the bottom of the beverage receiving cavity of the main container, the at least one hole is not plugged.

The device allows for the successive dispensing of two beverages without mixing.

Thus, the open position is the position from which the at least one hole of the secondary container is no longer plugged, enabling the communication between the beverage receiving cavity of the secondary container and the beverage receiving cavity of the main container in order to suck the beverage contained in the beverage receiving cavity of the secondary container through the suction nozzle.

The upper position is preferably the position in which the upper face of the secondary container is flush with the upper face of the main container. However, it is also possible to envision the upper position above the open position, without the two upper faces necessarily matching.

According to one embodiment, the secondary container comprises a single hole and the bottom of the beverage receiving cavity of the secondary container is inclined towards the hole, the communication providing means comprise a ball configured to be received in the secondary container, the ball being sized to plug the hole of the secondary container, and the communication providing means also comprise a rod protruding into the beverage receiving cavity of the main container up to the open position, the rod being sized such that when the secondary container is between the open position and the lower position, the rod extends into the hole without plugging it and pushes the ball, preventing the ball from plugging the hole of the secondary container and thus enabling the communication between the secondary container and the main container.

The bottom is preferably funnel-inclined toward the hole, enabling the ball to fall in order to plug the hole.

The ball preferably has sufficient density such that the ball falls to the bottom of the hole, regardless of the beverage in the secondary container.

Thus, as liquid is sucked from the main container and the secondary container descends into the main container, the rod enables the ball to be dislodged from the hole from the time that the secondary container reaches the open position.

The invention is not limited in relation to the number of holes in the secondary container, the main container having to contain an equivalent number of rods, and the secondary container having to be inserted into the main container so that the hole in the secondary container is aligned with the rod as it descends.

According to one embodiment, a seal is received in a groove, provided at the hole level, at the level of the bottom of the beverage receiving cavity of the secondary container.

According to one embodiment, the communication providing means comprise at least one rod connected to the main container and protruding into the beverage receiving cavity of the main container in correspondence with the at least one hole, and the at least one rod being sized such that, between the upper position and the open position, the at least one rod extends into the hole of the secondary container and completely plugs the corresponding at least one hole of the secondary container, and between the open position and the lower position, the at least one rod partially plugs the corresponding at least one hole of the secondary container, thereby enabling the communication between the secondary container and the main container.

According to one embodiment, the at least one rod comprises a step, such that when the secondary container is between the open position and the lower position, the step is partially in the beverage receiving cavity of the secondary container, thus enabling the communication between the secondary container and the main container.

According to one embodiment, the communication providing means comprise a single rod and a corresponding single hole of the secondary container.

According to one embodiment, the rod is centered with respect to the beverage receiving cavity of the main container and extends into the channel. This makes it easy for the user to place the secondary container into the main container.

According to one embodiment, the bottom of the beverage receiving cavity is inclined, in particular funnel-inclined, toward the hole.

This facilitates the flow of beverages, and the ball is forced by gravity to plug the through hole.

According to one embodiment, the beverage receiving cavity of the main container and the secondary container are cylindrical with the same generatrix, the secondary container being adapted to slide within the beverage receiving cavity of the main container.

According to one embodiment, the container is made of plastic material.

The main container can be formed of two portions, namely a lower portion comprising the bottom of said beverage dispensing device and an upper portion comprising the bottom of the beverage receiving cavity of the main container, the two portions being joined in a sealed manner in a horizontal plane in the position of the device placed on its bottom, the lower portion comprising at least a portion of the channel. In particular, the lower portion can carry the rod of the communication providing means.

According to one particular feature of the invention, the suction nozzle is straw-like.

According to one particular feature of the invention, at least one of the main container and the secondary container comprises filling markers.

Thus, it is possible for the user to fill the main container and the secondary container adequately, so that they function properly on the one hand, and to meet a prescribed dosage according to the type of liquid consumed, on the other hand.

BRIEF DESCRIPTION OF THE DRAWINGS

To better illustrate the subject-matter of the present invention, several embodiments are described below, indicative and non-restrictive, with reference to the appended drawings.

In these drawings.

DESCRIPTION OF THE PREFERRED EMBODIMENTS

Figure 1:
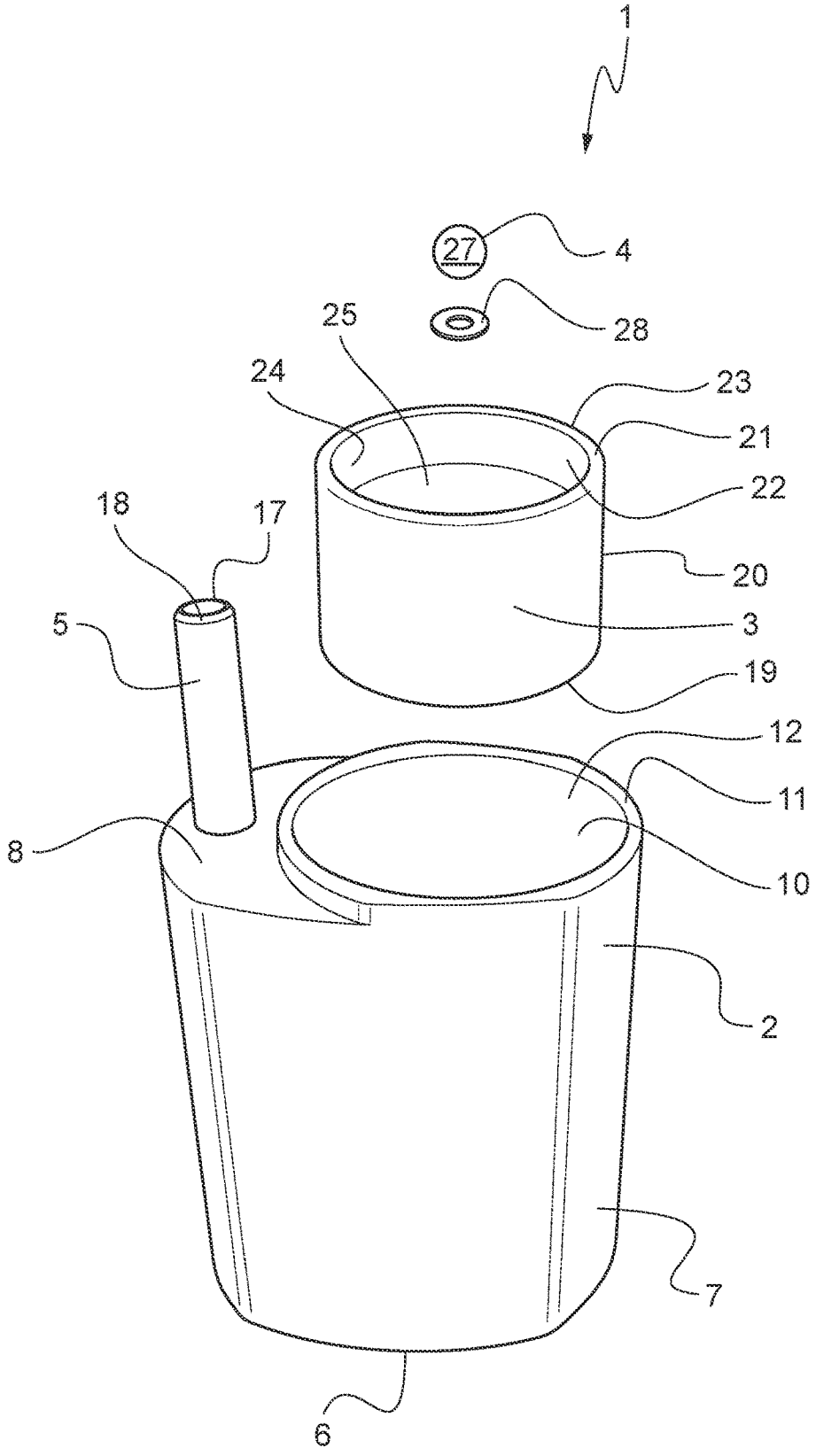
FIG. 1 is a perspective and exploded view of the beverage dispensing device according to the present invention.

Referring to FIG. 1, it can be seen that a beverage dispensing device 1 according to a first embodiment of the present invention is shown. The beverage dispensing device 1 comprises a main container 2, a secondary container 3, communication providing means 4 and a fluid suction nozzle 5.

Figure 2:
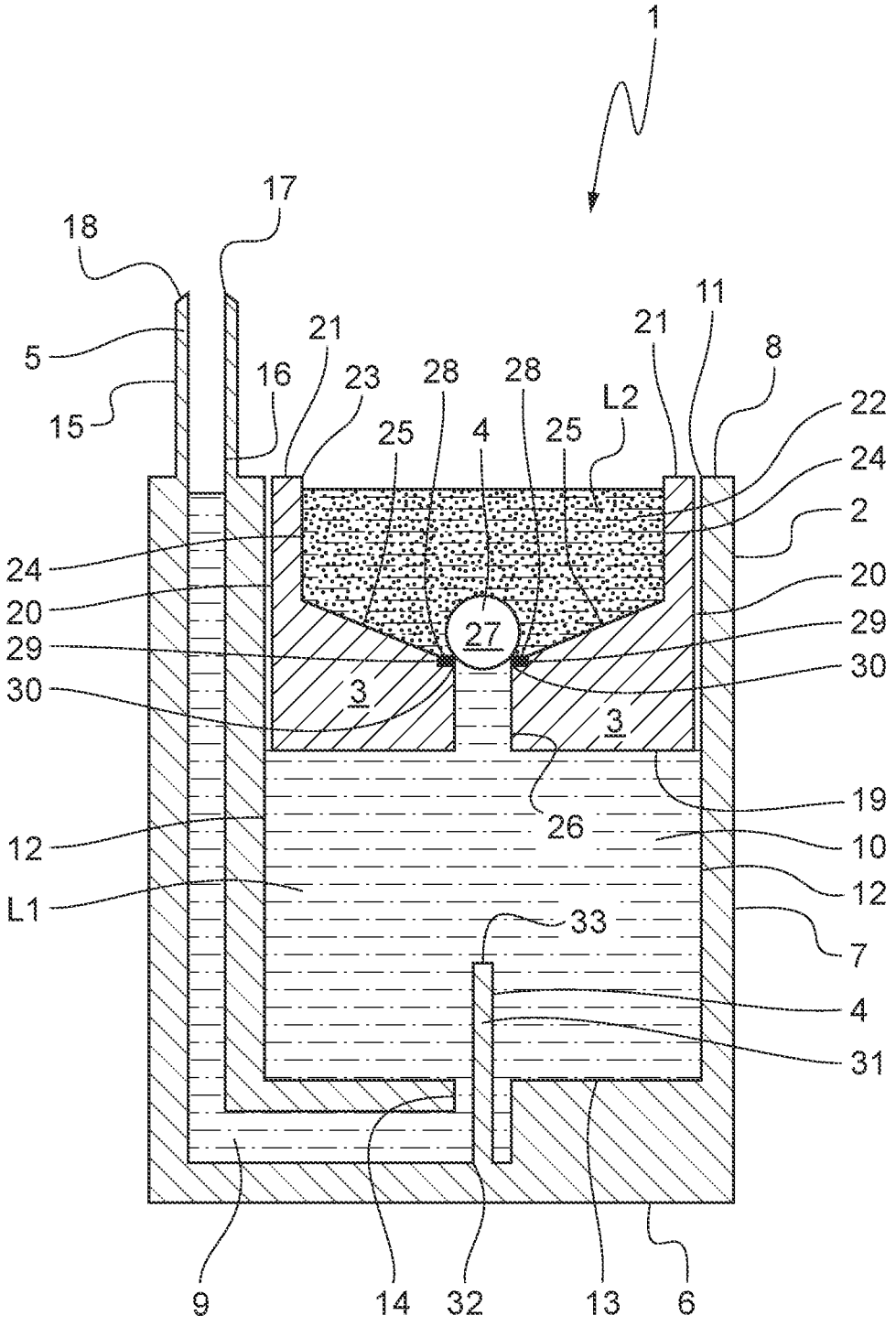
FIG. 2 is a cross-sectional view of the beverage dispensing device according to a first embodiment, at a first step.
Figure 3:
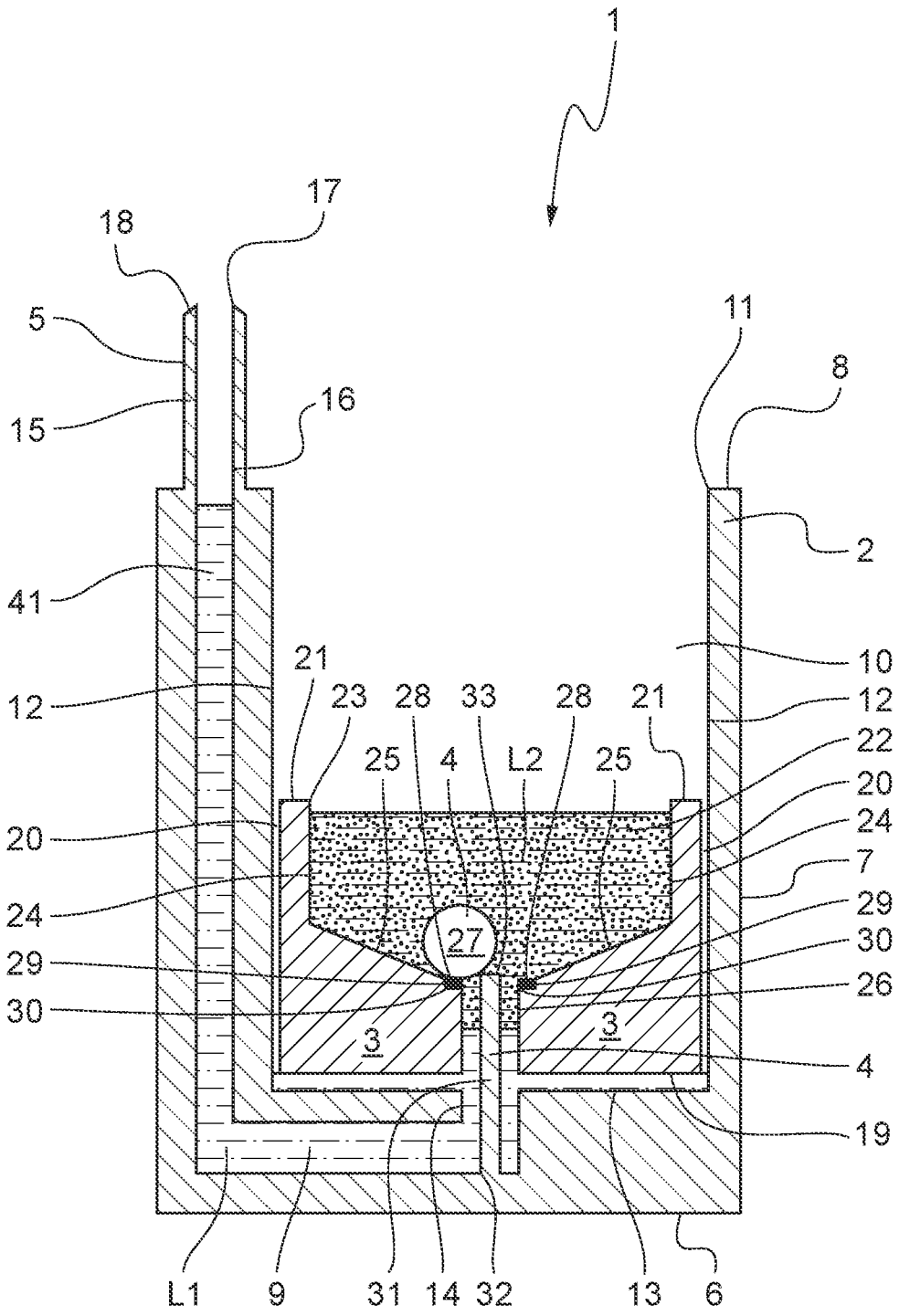
FIG. 3 is a cross-sectional view of the beverage dispensing device of FIG. 2, at a second step.
Figure 4:
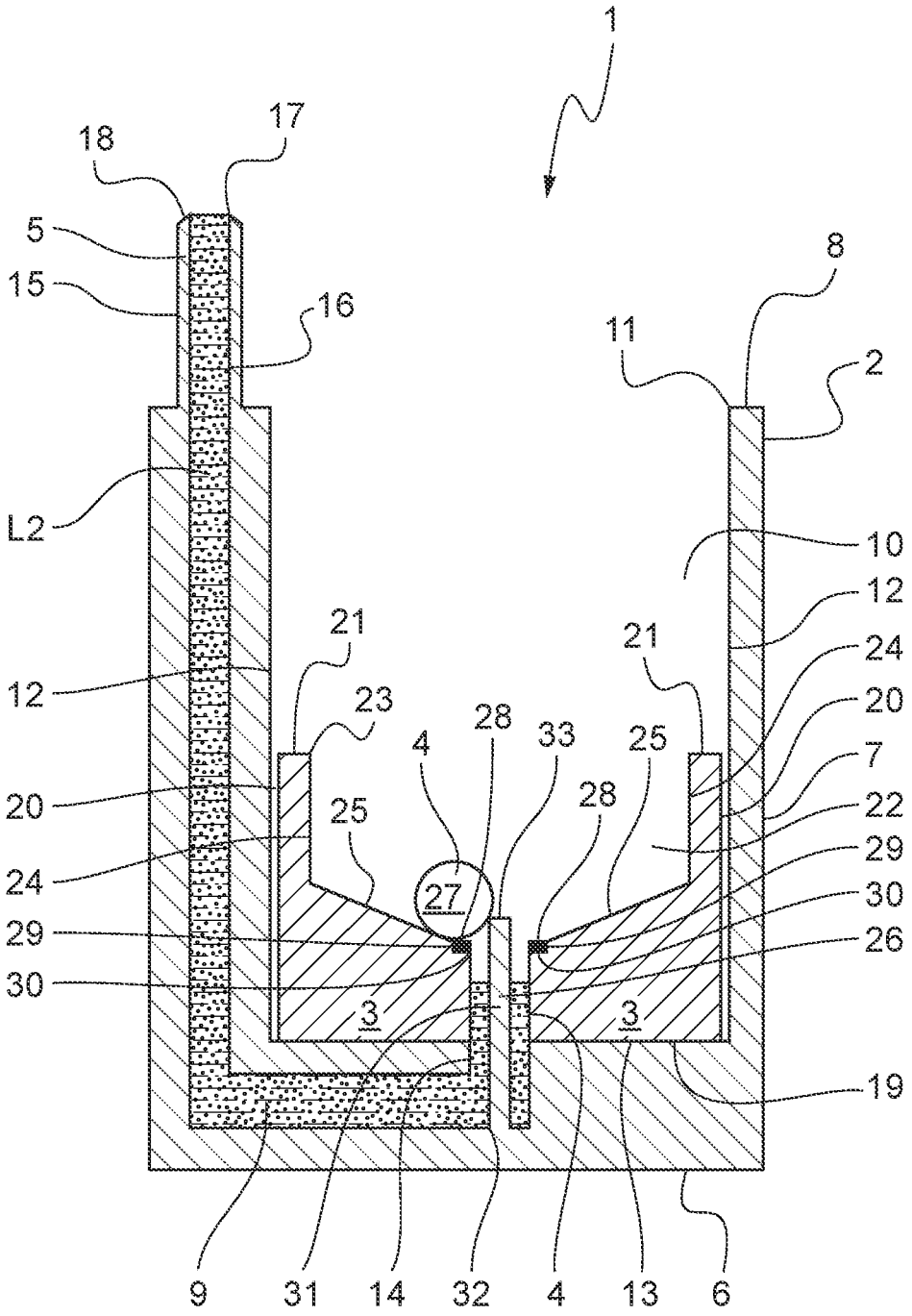
FIG. 4 is a cross-sectional view of the beverage dispensing device of FIG. 2, at a third step.

The main container 2 comprises a bottom 6, a side wall 7 and an upper face 8. The main container 2 is hollow so as to have a channel 9 therein, as can be seen in FIGS. 2-4.

The main container 2 further comprises a beverage receiving cavity 10. The beverage receiving cavity 10 extends from the upper face 8 toward the bottom 6. The beverage receiving cavity 10 thus comprises an upper opening 11, in the plane of the upper face 8, walls 12 and a bottom 13, as can be better seen in FIGS. 2-4. A hole 14 is also present at the level of the bottom 13 and is configured for enabling the communication between the beverage receiving cavity 10 and the channel 9.

In FIG. 1, it can be seen that the main container 2 is substantially cylindrical in shape. It should be noted, however, that any geometry may be considered without departing from the present invention. In addition, the main container 2 may have ergonomic features and/or be equipped with gripping means, in particular one or more handles formed on the side wall 7 of the main container 2.

The main container 2 is configured to hold a first liquid L1 in the beverage receiving cavity 10 and in the channel 9.

In FIG. 1, it can be seen that the fluid suction nozzle 5 is arranged at the level of the upper face 8 of the main container 2. As can also be seen in FIGS. 2-4, the fluid suction nozzle 5 comprises a hollow cylinder 15, open at both ends 16, 17 and extending from the upper face 8 of the main container 2. The hollow cylinder 15 is in communication with the channel 9, via one of its ends 16. The second, free end 17 is intended to be inserted into the mouth of a user of the beverage dispensing device 1. For this purpose, the second end 17 has chamfers 18.

The fluid suction nozzle 5 is configured to suck any liquid found in the main container 2. Due to the hole 14 present at the level of the bottom 13 of the beverage receiving cavity 10, the portion of the liquid L1 present in the channel 9 will be sucked before that present in the beverage receiving cavity 10.

As can be seen in FIGS. 1-4, the fluid suction nozzle 5 is preferably of the straw type. However, it should be noted that the person skilled in the art will be able to envisage any other fluid suction nozzle structure, as long as it is configured to enable the liquid present in the main container 2 to be taken from the channel 9.

The secondary container 3 comprises a lower face 19, walls 20 and a upper face 21. The secondary container 3 further comprises a beverage receiving cavity 22. The beverage receiving cavity 22 extends from the upper face 21 toward the lower face 19. The beverage receiving cavity 22 thus comprises a upper opening 23, in the plane of the upper face 21, walls 24 and a bottom 25, as can be better seen in FIGS. 2-4. A hole 26 is also present at the level of the bottom 25 and is configured to enable the communication between the beverage receiving cavity 22 and the exterior.

The secondary container 3 is configured to receive and contain a second liquid L2 in the beverage receiving cavity 22.

The main container 2 and the secondary container 3 are configured and sized such that the main container 2 is adapted to receive the secondary container 3 in its beverage receiving cavity 10, and are correspondingly configured such that the secondary container 3 is movable within the beverage receiving cavity 10 of the main container 2. In addition, the secondary container 3 and the beverage receiving cavity 10 of the main container 2 are sized such that, in the state of the secondary container 3 as received in the beverage receiving cavity 10 of the main container 2, the walls 20 of the secondary container 3 and the walls 12 of the beverage receiving cavity 10 of the main container 2 provide a seal such that liquid L1 present in the beverage receiving cavity 10 of the main container 2 is prevented from entering between them. Thus, the secondary container 3 is sealingly movable at the level of its walls 20 in the beverage receiving cavity 10 of the main container 2. Advantageously, as shown in FIG. 1, the secondary container 3 and the beverage receiving cavity 10 of the main container 2 are cylindrical and of the same generatrix, with the outer diameter of the secondary container 3 being substantially smaller than the inner diameter of the beverage receiving cavity 10.

In the state of the secondary container 3 as received in the beverage receiving cavity 10 of the main container 2, the hole enables the communication between the beverage receiving cavity 22 of the secondary container 3 on the one hand and the beverage receiving cavity 10 and the channel 9 of the main container 2 on the other hand.

In addition, the hole 26 of the secondary container 3 and the hole 14 of the main container 2 are arranged and sized in such a way that in the state of the secondary container 3 as received in the beverage receiving cavity 10 of the main container 2, they are opposite each other. And in the state of the secondary container 3 resting on the bottom 13 of the beverage receiving cavity 10 of the main container 2, the hole 26 of the secondary container 3 and the hole 14 of the main container 2 are in communication. For example, and as shown in FIGS. 2-4, the hole 26 of the secondary container 3 and the hole 14 of the main container 2 are centered and of the same diameter.

The secondary container 3 is made with such a geometry and of such a material that it is configured to float on a liquid L1 contained in the beverage receiving cavity 10 of the main container 2. The secondary container 3 can be made of a plastic material such as polycarbonate, acrylonitrile butadiene styrene, polyvinyl chloride or polyamide. Advantageously, the secondary container 3 is made of a material with a density of less than 1 (water at 4° C. being taken as the reference body).

The communication providing means 4 are configured to enable the communication between the interior of the beverage receiving cavity 22 of the secondary container 3 and the interior of the beverage receiving cavity 10 of the main container 2 and the channel 9 of the main container 2.

According to a first embodiment shown in FIGS. 1-4, the communication providing means 4 comprises a ball 27. The ball 27 is configured and sized so that, when received in the beverage receiving cavity 22 of the secondary container 3, it plugs the hole 26 and thereby prevents the communication between the beverage receiving cavity 22 and the exterior. As can be better seen in FIGS. 2-4, the bottom 25 of the beverage receiving cavity 22 of the secondary container 3 is funnel-inclined from the walls 24 toward the hole 26 so as to force the ball 27 to come to plug the hole 26 by gravity. In addition, the fact that the bottom 25 of the beverage receiving cavity 22 of the secondary container 3 is inclined enables the second liquid to be guided toward the hole 26 to flow into it. Advantageously, the hole 26 is cylindrical. In this case, the ball 27 has a diameter larger than the hole 26. Preferably, the ball is made of a material having a density greater than that of water, such as stainless steel.

In addition, advantageously and as shown in FIGS. 2-4, a seal 28 is received in a groove 29, provided at the level of the peripheral area 30 of the hole 26, located at the level of the bottom 25 of the beverage receiving cavity 22. Thus, the sealing of the closure is guaranteed.

The communication providing means 4 according to the first embodiment shown in FIGS. 1-4 also comprises a rod 31. The rod 31 is arranged with a first end 32 at the level of the lower face 6 of the main container 2 and the rod 31 comprises a free end 33 extending toward the upper face 8 of the main container 2, along the direction of the generatrix of the cylindrical beverage receiving cavity 10 of the main container 2. As can be seen in FIGS. 2-4, the rod 31 is arranged centrally with respect to the hole 14 in the bottom 13 of the beverage receiving cavity 10, is sized to extend through the channel 9, through the hole 14 in the bottom 13 of the beverage receiving cavity 10 without plugging it, and is sized so that its free end 33 is within the beverage receiving cavity 10, beyond the through hole 14 in the bottom 13 of the beverage receiving cavity 10.

Due to the fact that, in the state of the secondary container 3 as received in the beverage receiving cavity 10 of the main container 2, the hole 14 of the main container 2 and the hole 26 of the secondary container 3 face each other, the free end 33 of the rod 31 in this state also faces the hole 26 of the secondary container 3.

The rod 31 is sized such that when the secondary container 3 rests on the bottom 13 of the beverage receiving cavity 10 of the main container 2, it passes through the hole 26 of the secondary container 3 without closing it, and its free end 33 is in the beverage receiving cavity 22 of the secondary container 3, beyond the hole 26 of the secondary container 3, as shown in FIG. 4.

It can also be seen in FIG. 3 that, for a position of the secondary container 3 near the bottom 13 of the beverage receiving cavity 10 of the main container 2, the rod 31 is also sized such that its free end 33 is in the beverage receiving cavity 22 of the secondary container 3, beyond the hole 26 of the secondary container 3.

Generally, the communication providing means 4 of the beverage dispensing device 1 according to the present invention are configured so that, in the state of the secondary container 3 as received in the beverage receiving cavity 10 of the main container 2, they prevent/allow the communication between the beverage receiving cavity 22 of the secondary container 3 on the one hand, and the beverage receiving cavity 10 and the channel 9 of the main container 2 on the other hand, that is, they prevent/allow dispensing of the second liquid L2 from the secondary container 3 toward the main container 2.

According to the first embodiment, the ball 27 and the rod 31 of the communication providing means 4 are configured to interact so as to enable the communication between the beverage receiving cavity 22 of the secondary container 3 and the beverage receiving cavity 10 and the channel 9 of the main container 2, as explained below.

Thus, as can be seen in FIG. 3, when the secondary container 3 is at such a distance from the bottom 13 of the beverage receiving cavity 10 of the main container 2 that the free end 33 of the rod 31 is in the beverage receiving cavity 22 of the secondary container 3, beyond the hole 26 of the secondary container 3, the ball 27 is pushed by the free end 33 of the rod 31. This position of the secondary container 3 in the main container 2 corresponds to a so-called open position. The fact that the rod 31 extends into the beverage receiving cavity 22 of the secondary container 3 beyond the hole 26 of the secondary container 3, prevents the ball 27 from plugging the hole 26 of the secondary container 3. This has the effect, up to the position where the secondary container 3 rests on the bottom 13 of the beverage receiving cavity 10 of the main container 2, of enabling the communication between the beverage receiving cavity 22 of the secondary container 3 and the beverage receiving cavity 10 of the main container 2, thus allowing the second liquid L2 to be dispensed from the secondary container 3 toward the main container 2.

Due to the communication providing means 4, the beverage dispensing device 1 according to the present invention comprises a dispensing range of first liquid and a dispensing range of second liquid.

A dispensing range of first liquid is defined as the range of movement of the secondary container 3 in the beverage receiving cavity 10 of the main container 2, between an upper position of the secondary container 3 in the beverage receiving cavity 10 of the main container 2, with the upper face 21 of the secondary container 3 being flush with the upper face 8 of the main container 2, and an open position of the secondary container 3 with contact between the ball 27 and the free end 33 of the rod 31. In this range, the hole 26 of the secondary container 3 is plugged by the ball 27. Only the first liquid L1 contained in the main container 2 (either in the channel 9 and totally or partially in the beverage receiving cavity 10, or only in the channel 9) can be sucked by the user through the fluid suction nozzle 5.

A dispensing range of second liquid is defined as the range of movement of the secondary container 3 in the beverage receiving cavity 10 of the main container 2, between a position lower than the open position, in which the free end 33 of the rod 31 pushes the ball 27 and the ball 27 no longer plugs the hole 26 of the secondary container 3, and a lower position of the secondary container 3 in which the secondary container 3 rests on the bottom 13 of the beverage receiving cavity 10 of the main container 2. In this range, the beverage receiving cavity 22 of the secondary container 3 is either in communication with the beverage receiving cavity 10 of the main container 2 or in communication with the channel 9 of the main container 2. The second liquid L2 can thus be sucked by the user after the first liquid L1. It should be noted that the open position can correspond to the lower position.

Figure 5:
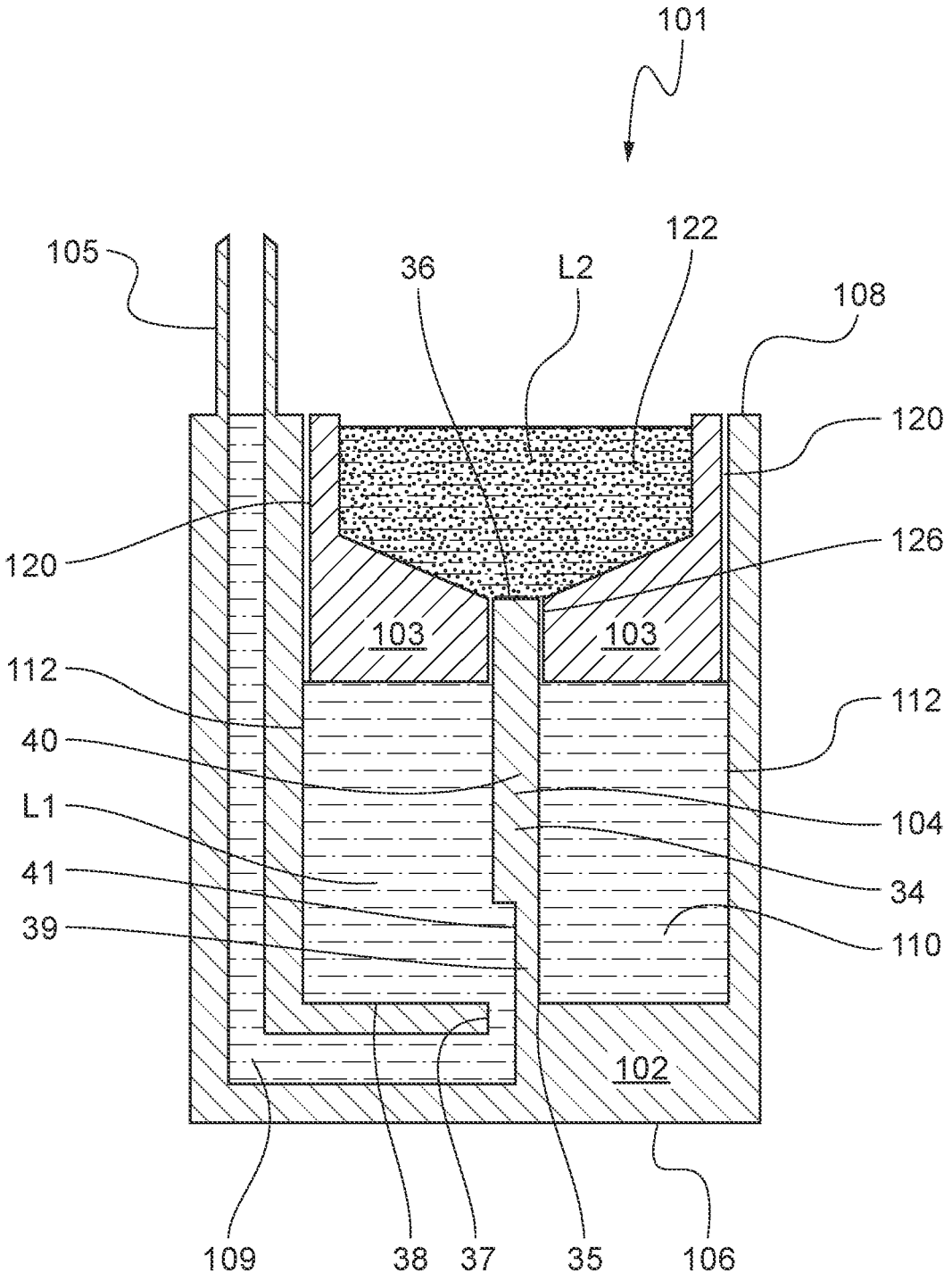
FIG. 5 is a cross-sectional view of the beverage dispensing device according to a second embodiment, at a first step.
Figure 6:
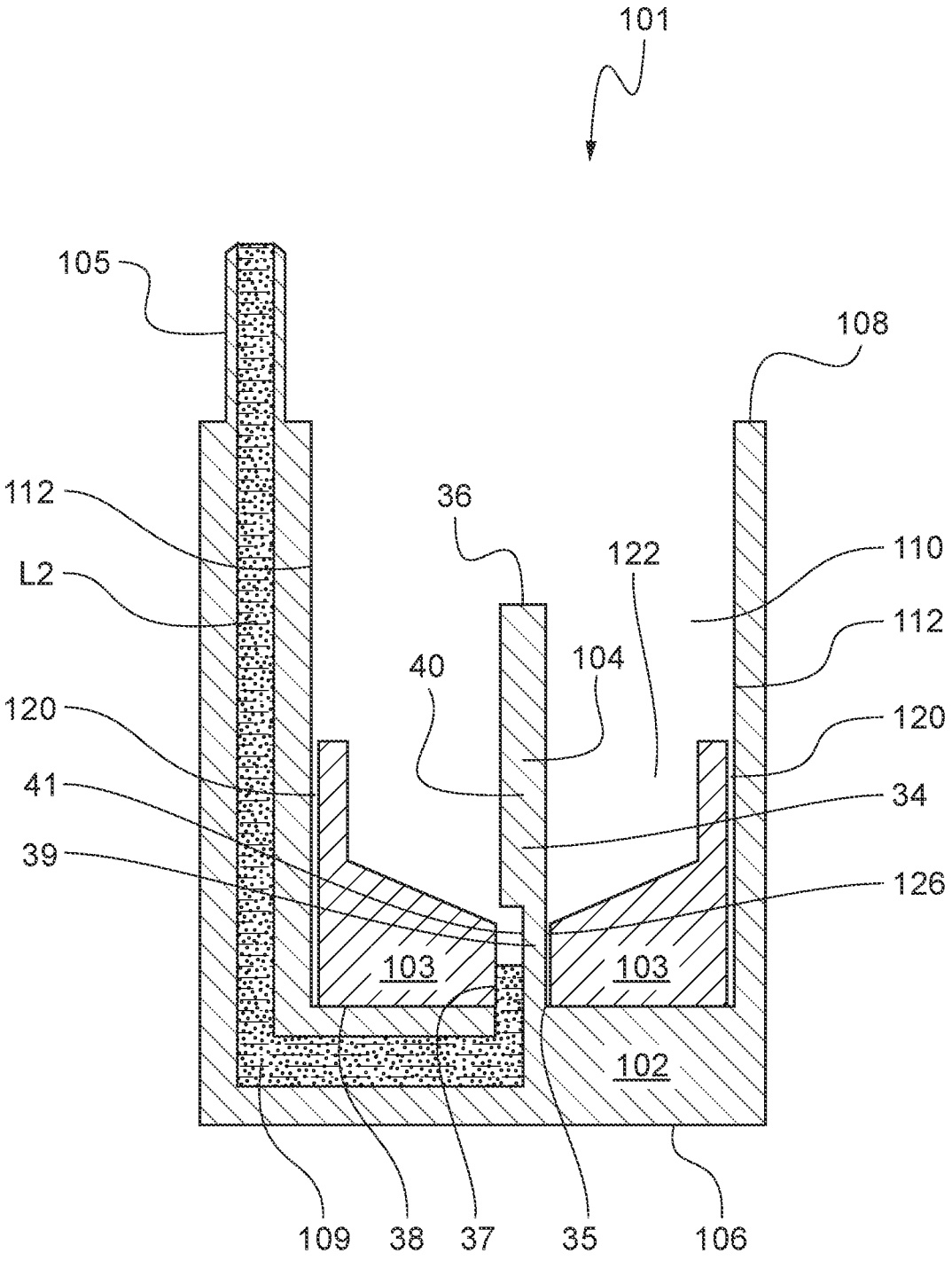
FIG. 6 is a cross-sectional view of the beverage dispensing device of FIG. 5, at a second step.

Referring to FIGS. 5-6, it can be seen that a beverage dispensing device 101 according to a second embodiment of the present invention is shown. The beverage dispensing device 101 is similar to the beverage dispensing device 1 according to the first embodiment described above. Elements of the beverage dispensing device that are identical or similar to the elements of the beverage dispensing device of the first embodiment, and described with reference to FIGS. 5-6, will bear the same reference numerals increased by 100, and will not be described further here.

As before, the beverage dispensing device 101 comprises a main container 102, a secondary container 103, communication providing means 104 and a suction nozzle 105.

According to the second embodiment, the communication providing means 104 comprises a rod 34. The rod 34 is arranged with a first end 35 at the level of the lower face 106 of the main container 102 and the rod 34 comprises a free end 36 extending toward the upper face 108 of the main container 102. As can be seen in FIGS. 5-6, the rod 34 is preferably centrally arranged. The rod 34 is sized so that its free end 36 is within the beverage receiving cavity 110.

As can be seen in FIGS. 5-6, the rod 34 is arranged laterally and adjacent to the hole 37 in the bottom 38 of the beverage receiving cavity 110 of the main container 102.

The rod 34 comprises a lower portion 39 and an upper portion 40. The rod 34 is sized such that the lower portion 39 has a smaller thickness than the upper portion 40, from a step 41. In fact, in FIGS. 5-6, it can be seen that the rod 34 has a right-angle step 41 at the level of the interface between the lower portion 39 and the upper portion 40. The step 41 is located in the beverage receiving cavity 110 of the main container 102 and opposite the hole 37 in the bottom 38 of the beverage receiving cavity 110 of the main container 102.

It should be noted that the person skilled in the art will know of envisaging other geometries, such as a linear or curved thickness reduction, between the upper portion 40 and the lower portion 39 of the rod 34, provided that at least a portion of the rod with reduced thickness is located within the beverage receiving cavity 110 of the main container 102 and opposite the hole 37 in the bottom 38 of the beverage receiving cavity 110 of the main container 102.

The rod 34 and the secondary container 103 are configured and sized such that in the state of the secondary container 103 as received in the beverage receiving cavity 110 of the main container 102, the rod 34 is received in the hole 126 of the secondary container 103. In addition, the rod 34, over its entire upper portion 40, plugs the hole 126 of the secondary container 103 in a sealing manner, while allowing the secondary container 103 to sealingly slide along the rod 34.

It can be seen in FIG. 6 that the rod 34 is sized such that when the secondary container 103 rests on the bottom 113 of the beverage receiving cavity 110 of the main container 102, it passes through the hole 126 of the secondary container 103, with the upper portion 40 thereof in the beverage receiving cavity 122 of the secondary container 103, beyond the hole 126 of the secondary container 103, and with the lower portion 39 thereof, and thus the step 41, partially in the hole 126 of the secondary container 103. Thus, due to the lower portion 39 being partially within the hole 126 of the secondary container 103, the latter is not plugged, thereby enabling the communication between the beverage receiving cavity 122 of the secondary container 103 and the channel 109 of the main container 102. The second liquid L2 can thus be sucked by the user after the first liquid L1.

In addition, the rod 34 is sized such that, for a secondary container 103 position near the bottom 113 of the beverage receiving cavity 110 of the main container 102, the step 41 is also in the beverage receiving cavity 122 of the secondary container 103.

In other words, as long as the upper portion 40 of the rod occupies all of the hole 126 of the secondary container 103, the upper portion 40 of the rod 34 plugs the hole 126 of the secondary container 103, thereby preventing the communication between the beverage receiving cavity 122 of the secondary container 103 and the channel 109 of the main container 102 and thereby preventing the second liquid L2 from being sucked by the user. Only the first liquid L1 contained in the main container 102 (either in the channel 109 and in the beverage receiving cavity 110, or only in the channel 109) can be sucked by the user through the suction nozzle 105. This concerns the dispensing range of first liquid.

And, once the upper portion 40 of the rod 34 is entirely beyond the hole 126 of the secondary container 103, that is, the step 41 is beyond the hole 126 of the secondary container 103, the upper portion 40 of the rod 34 no longer plugs the hole 126 of the secondary container 103, and the lower portion 39 enables the communication between the beverage receiving cavity 122 of the secondary container 103 and the channel 109 of the main container 102 and thus allowing the second liquid L2 to be sucked by the user after the first liquid L1. This concerns the dispensing range of second liquid.

The operation of the beverage dispensing device 1 according to the first embodiment will be described below, with reference to FIGS. 2-4.

Initially, the user pours a first liquid L1, for example water, into the main container 2, through the upper opening 11. The liquid L1 then flows into the beverage receiving cavity 10 and then through the hole 14 into the channel 9.

Second, the user places the ball 27 in the secondary container 3. Due to the inclination of the funnel-shaped bottom 25 of the beverage receiving cavity 22, the ball plugs the hole 26 in the bottom 25 of the beverage receiving cavity 22. A second liquid L2, of a type different than the first liquid L1, such as a sweetened beverage, is poured into the secondary container 3 through the upper opening 23. As the ball 27 plugs the hole 26 in the bottom 25, the liquid L2 is held in the secondary container 3.

The user then places the secondary container 3 into the beverage receiving cavity 10 of the main container 2 via the upper opening 11. It is understood that the secondary container 3 can be placed beforehand, with the ball 27 in it, in the beverage receiving cavity 10 of the main container 2 before the second liquid L2 is poured in. Due to the ball 27 plugging the hole 26, the second liquid L2 does not mix with the first liquid L1.

Due to the geometry and density of the secondary container 3, it floats on the surface of the first liquid L1, as can be seen in FIG. 2. It is preferable not to completely fill the beverage receiving cavity 10 of the main container 2 with the first liquid L1 so as to leave a free volume at the level of the upper opening 11 which is sufficient to stably insert the secondary container 3. Likewise, the first liquid L1 will be filled sufficiently so that the secondary container 3 is within the dispensing range of first liquid, that is, the secondary container 3 is in a position in the beverage receiving cavity 10 of the main container 2 such that the free end 33 of the rod 31 is not in contact with the ball 27.

Advantageously, the beverage receiving cavity 10 of the main container 2 can comprise filling markers.

When the user sucks on the suction nozzle 5, a vacuum is created and thus the first liquid L1 is sucked in, at first the first liquid L1 present in the channel 9 of the main container 2 and then the first liquid L1 present in the drink receiving cavity 10 of the main container 2. The level of the liquid L1 in the beverage receiving cavity 10 of the main container 2 is lowered, and thereby the secondary container 3 is lowered concomitantly. From the starting position of the secondary container 3 and until the free end 33 of the rod 31 contacts the ball 27, that is, as long as the secondary container 3 is in the dispensing range of first liquid L1, only the first liquid L1 is consumed by the user.

Once enough of the first liquid L1 is sucked to lower the secondary container 3 such as it enters into the dispensing range of second liquid, either for a position lower than the open position, or a position in which the ball 27 contacts the free end 33 of the rod 31, the free end 33 of the rod 31 pushes the ball 27 into the beverage receiving cavity 22 of the secondary container 3. Since the beverage receiving cavity 22 of the secondary container 3 is in communication with the beverage receiving cavity 10 of the main container 2, the suction of the first liquid L1 leads to the suction thereafter of the second liquid L2, until it is completely consumed, as can be seen in FIGS. 3 and 4.

The operation of the beverage dispensing device 101 according to the second embodiment will be described below, with reference to FIGS. 5-6.

The operation of the beverage dispensing device 101 according to the second embodiment is similar to that of the beverage dispensing device 1 according to the first embodiment.

A first liquid L1 is poured into the beverage receiving cavity 110 of the main container 102.

Then, the user arranges the secondary container 103 in the beverage receiving cavity 110 of the main container 102, as can be seen in FIG. 5. As before, it is preferable not to completely fill the beverage receiving cavity 110 of the main container 102 with the first liquid L1 so as to leave a free volume at the level of the upper opening 111 sufficient to stably insert the secondary container 103. Similarly, the first liquid L1 will be filled sufficiently so that the secondary container 103 is in the dispensing range of first liquid, that is, the secondary container 103 is in the upper position, that is, the position where the upper portion 40 of the rod 34 occupies the entire hole 126 of the secondary container 103. Advantageously, the beverage receiving cavity 110 of the main container 102 can comprise filling markers.

Suction of the first liquid L1 leads to the lowering of the secondary container 103. From the starting position of the secondary container 103 and as long as the upper portion 40 of the rod 34 occupies the entire hole 126 of the secondary container 103, that is, as long as the secondary container 103 is within the dispensing range of first liquid L1 and up to the opening position, only the first liquid L1 is consumed by the user.

Once a sufficient quantity of the first liquid L1 is sucked to lower the secondary container 103 such that it enters into the dispensing range of second liquid, that is, for a position of the secondary container 103 lower than the open position, that is, a position in which the upper portion 40 of the rod 34 is entirely beyond the hole 126 of the secondary container 103, with the step 41 being beyond the hole 126 of the secondary container 103, the sucking of the first liquid L1 leads to the sucking of the second liquid L2 thereafter, as can be seen in FIG. 6.

Thus, with the beverage dispensing device 1; 101 according to the present invention, throughout the consumption process up to the open position, the first liquid L1 and the second liquid L2 do not mix.

In addition, the beverage dispensing device 1; 101, for an equivalent amount of liquid, allows for consumption of fewer products harmful to health. Indeed, in the case of sweetened beverages, the fact of drinking a volume of water and then a smaller volume of sweetened beverage in sequence, ending with the sweetened beverage, leads, thanks to the retro-olfaction phenomenon, to the user feeling a feeling of satisfaction equivalent to the one felt after having consumed the same quantity of sweetened beverage.

It should be noted that the main container 2; 102 and the secondary container 3; 103 can be configured such that the walls 20; 120 of the secondary container 3; 103 and the walls 12; 112 of the beverage receiving cavity 10; 110 of the main container 2 are spaced apart from each other, as long as they allow for the systematic insertion of the rod 31, 34 into the hole 26; 126 of the secondary container 3; 103.

It should be noted that the beverage dispensing device can comprise more than one rod, the secondary container then comprising an equivalent number of holes, these being arranged in a corresponding manner. In the case of the first embodiment, the bottom may be partitioned into compartments partitioned from each other for this purpose, each having a bottom inclined as a funnel toward a hole and into which a ball is received.

A means for guiding the secondary container in the beverage receiving cavity of the main container, for example of the rib/groove or foolproof type, may also be envisaged so as to guide each hole of the secondary container systematically toward a corresponding rod.

In addition, the rod of the matching means is not necessarily centered, as long as the hole of the secondary container is correspondingly arranged.

It should also be noted that the embodiments are shown by way of illustration and that the rod of the communication providing means is not limitative. The person skilled in the art will be able to envisage other means, as long as they open into the beverage receiving cavity of the main container and are configured to enable the communication between the secondary container and the main container.

Advantageously, the beverage receiving cavity 22; 122 of the secondary container 3; 103 can comprise fill markers.

Advantageously, the beverage dispensing device 1; 101 is made of plastic.

It is understood that the embodiments just described have been given by way of indication and are not limitative, and that embodiments may be added thereto without departing from the scope of the present invention.

Figure 7:
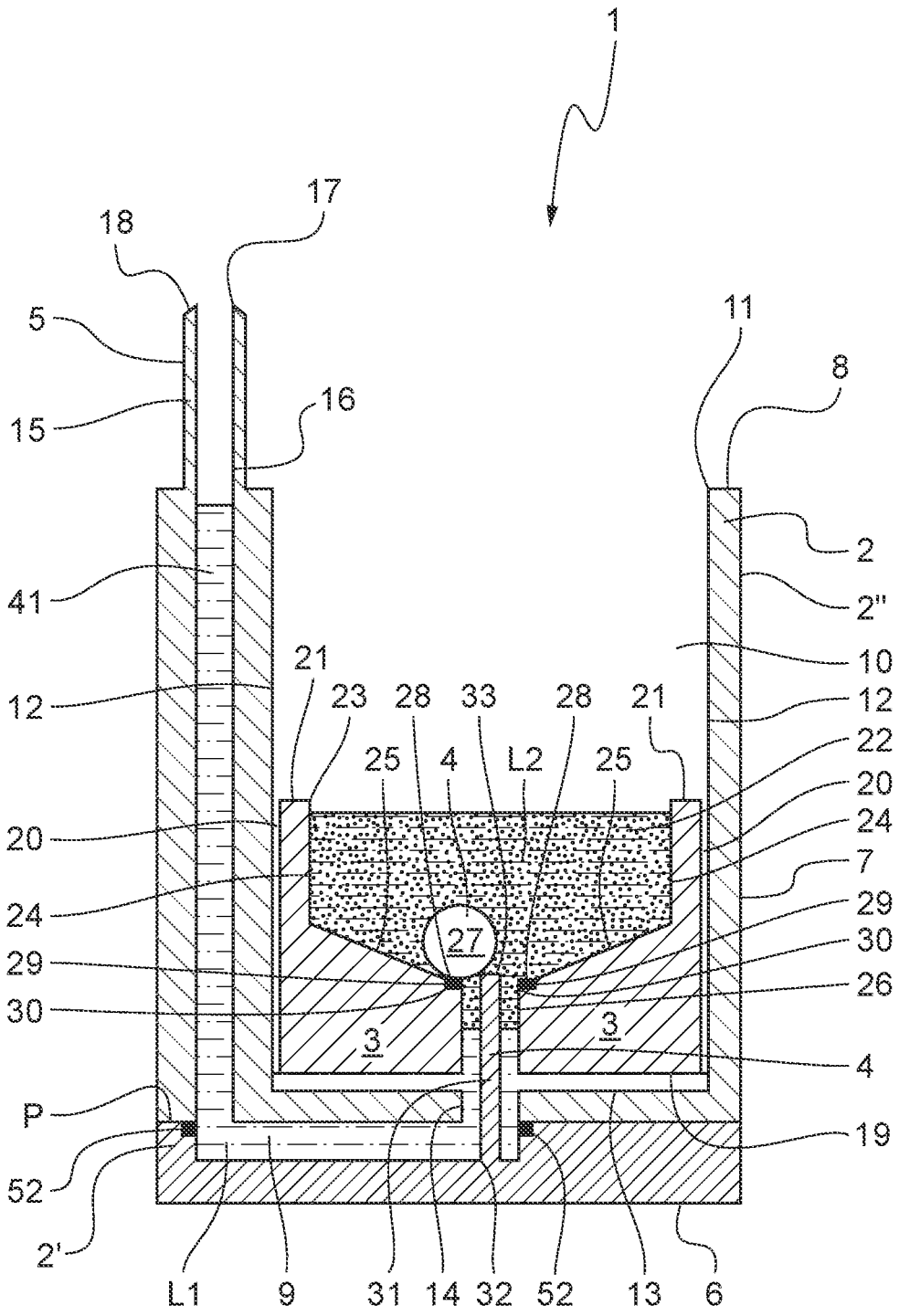
FIG. 7 is a cross-sectional view corresponding to FIG. 3 illustrating a variant embodiment of the main container of the beverage dispensing device according to the first and second embodiments.
Figure 8:
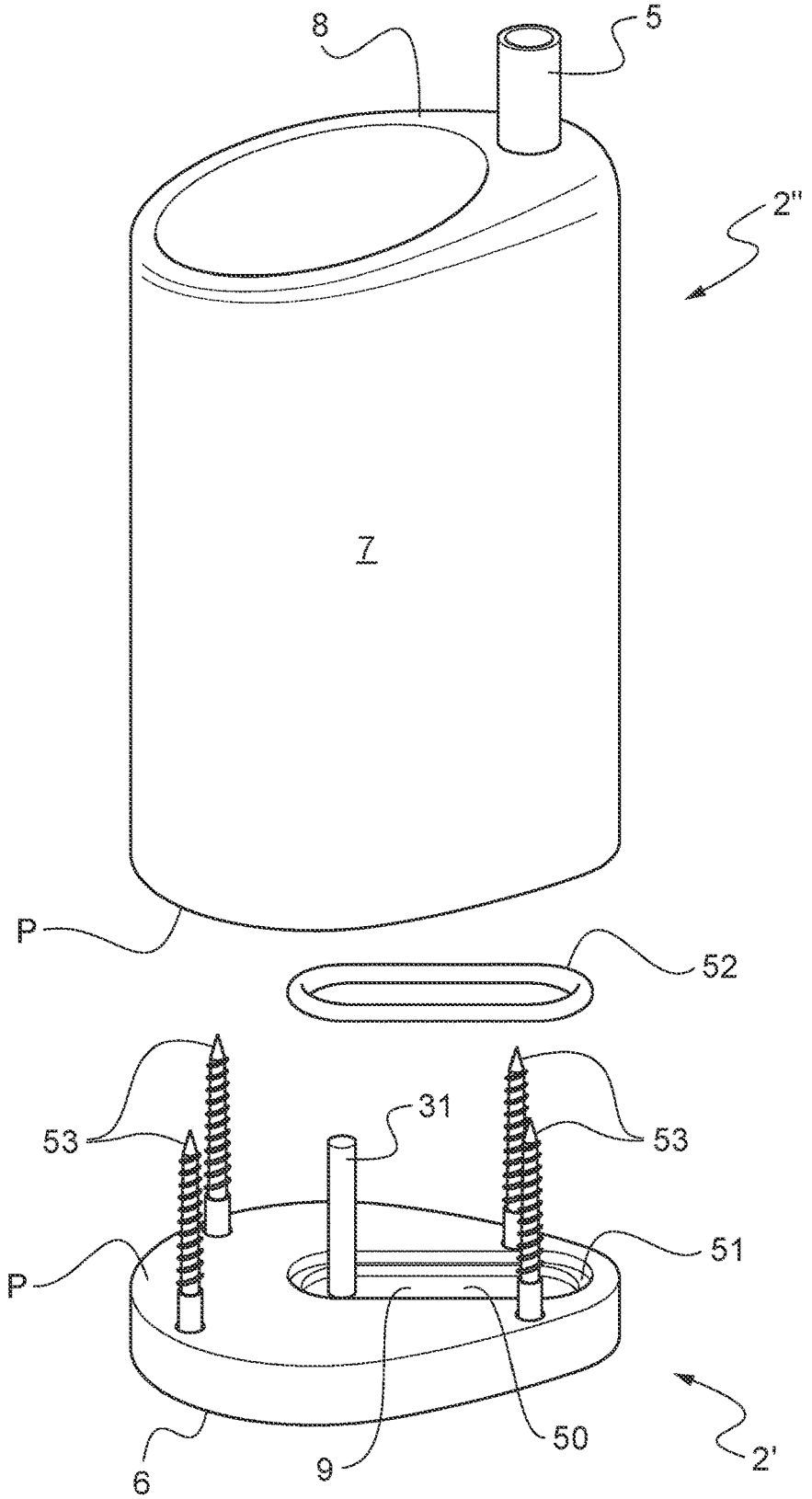
FIG. 8 is an exploded perspective view showing such a main container made according to this variant.

For production convenience, the main container 2 can be made in two portions as can be seen in FIGS. 7 and 8, namely:

- a lower portion 2' comprising the bottom 6 and the horizontal portion of the channel 9; and
- an upper portion 2" comprising the bottom 13, the two portions being joined in a sealing manner by screwing in a horizontal plane P (see FIG. 7).

As can be seen in FIG. 8, the portion 2', on its upper face opposite the bottom 6, comprises an oblong recessed portion 50 for the formation of the horizontal portion of the channel 9, the inner side wall of which comprises a step 51 on which a seal 52 is intended to be placed.

The rod 31, the role of which has been indicated above, stands from the bottom of the recessed portion 50.

In the example shown, the portion 2' is pierced in four places evenly distributed near its edge for the passage of screws 53 passing vertically through it for fixing said portion 2' to the portion 2", which has holes for receiving the screws 53 in its lower wall.

For assembly, the portions 2' and 2" are applied one on top of the other in the plane P and the screws 53 are introduced and put in place through the bottom 6.

The invention claimed is:

1. A beverage dispensing device (1; 101), comprising a main container (2; 102), comprising a bottom (6; 106) and a side wall (7) extending from the bottom (6; 106) towards an upper face (8; 108), a beverage receiving cavity (10; 110) being formed in the main container (1; 101), extending from the bottom (6; 106) and opening onto the upper face (8; 108), the bottom (13) of the beverage receiving cavity (10; 110) communicating with a channel (9; 109) circulating in the main container (2; 102), the channel (9; 109) providing a communication between the bottom (13) of the beverage receiving cavity (10; 110) and a fluid suction nozzle (5; 105) protruding from the upper face (8; 108) of the main container (2; 102) to enable a user to suck fluid contained in the beverage receiving cavity (10; 110) of the main container (2; 102) through the suction nozzle (5; 105), a secondary container (3; 103) adapted to be movable within the beverage receiving cavity (10; 110) of the main container (2; 102), the secondary container (3; 103) comprising a beverage receiving cavity (22; 122) opening onto an upper face (21) of the secondary container (3; 103), at least one hole (26; 126) being formed in the bottom (25) of the beverage receiving cavity (22; 122) of the secondary container (3; 103), the beverage dispensing device (1; 101) comprising communication providing means (4; 104) between the interior of the beverage receiving cavity (22; 122) of the secondary container (3; 103) and the interior of the beverage receiving cavity (10; 110) of the main container (2; 102) and the channel (9; 109) of the main container (2; 102), said communication providing means (4; 104) being configured so that when the secondary container (3; 103) is in the beverage receiving cavity (10; 110) of the main container (2; 102), between an upper position of the secondary container (3; 103) and an open position of the secondary container (3; 103), the at least one hole (26; 126) formed in the bottom (25) of the beverage receiving cavity (22; 122) of the secondary container (3; 103) is plugged, and between the open position and a lower position of the secondary container (3; 103) in which the secondary container (3; 103) touches the bottom (13) of the beverage receiving cavity (10; 110) of the main container (2; 102), the at least one hole (26; 126) is not plugged.

2. The beverage dispensing device (1) according to claim 1, wherein the secondary container (3) comprises a single hole (26) and the bottom (25) of the beverage receiving cavity (22) of the secondary container (3) is inclined towards the hole (26), the communication providing means (4) comprise a ball (27) configured to be received in the secondary container (3), the ball (27) being sized to plug the hole (26) of the secondary container (3), and the communication providing means (4) also comprise a rod (31) protruding into the beverage receiving cavity (10) of the main container (2) up to the open position, the rod (31) being sized such that when the secondary container (3) is between the open position and the lower position, the rod (31) extends into the hole (26) without plugging the hole and pushes the ball (27), preventing the ball (27) from plugging the hole (26) of the secondary container (3) and thus enabling the communication between the secondary container (3) and the main container (2).

3. The beverage dispensing device (1) according to claim 2, wherein a seal (28) is received in a groove (29), provided at the level of the hole (26), at the level of the bottom (25) of the beverage receiving cavity (22) of the secondary container (3).

4. The beverage dispensing device (101) according to claim 1, wherein the communication providing means (104) comprise at least one rod (34) connected to the main container (102) and protruding into the beverage receiving cavity (110) of the main container (102) in correspondence with the at least one hole (126), and the at least one rod (34) being sized such that between the upper position and the open position, the at least one rod (34) extends into the hole (126) of the secondary container (103) and completely plugs the corresponding at least one hole (126) of the secondary container (103), and between the open position and the lower position, the at least one rod (34) partially plugs the corresponding at least one hole (126) of the secondary container (103), thereby enabling the communication between the secondary container (130) and the main container (102).

5. The beverage dispensing device (101) according to claim 4, wherein the at least one rod (34) comprises a step (41), so that when the secondary container (103) is between the open position and the lower position, the step (41) is partially in the beverage receiving cavity (122) of the secondary container (103), thus providing a communication between the secondary container (103) and the main container (102).

6. The beverage dispensing device (1; 101) according to claim 2, wherein the communication providing means (4; 104) comprise a single rod (31, 34) and a corresponding single hole (26; 126) of the secondary container (3; 103).

7. The beverage dispensing device (1; 101) according to claim 6, wherein the rod (31; 34) is centered with respect to the beverage receiving cavity (10; 110) of the main container (2; 102) and extends into the channel (9; 109).

8. The beverage dispensing device (1; 101) according to claim 6, wherein the bottom of the beverage receiving cavity (22; 122) is inclined towards the hole (26; 126).

9. The beverage dispensing device (1; 101) according to claim 1, wherein the beverage receiving cavity (10; 110) of the main container (2; 102) and of the secondary container (3; 103) are cylindrical and of the same generatrix, the secondary container (3; 103) being adapted to slide within the beverage receiving cavity (10; 110) of the main container (2; 102).

10. The beverage dispensing device (1; 101) according to claim 1, wherein the secondary container (3; 103) is made of plastic material.

11. The beverage dispensing device (1; 101) according to claim 1, wherein the main container (2) is formed of two portions, namely a lower portion (2') comprising the bottom (6) of said beverage dispensing device (1; 101) and an upper portion (2") comprising the bottom (13) of the beverage receiving cavity (10; 110) of said main container (2; 102), the two portions being joined in a sealed manner in a horizontal plane (P) in the position of the device placed on the bottom (6), the lower portion comprising at least a portion of the channel (9).

12. A device according to claim 11, wherein the secondary container (3) comprises a single hole (26) and the bottom (25) of the beverage receiving cavity (22) of the secondary container (3) is inclined towards the hole (26), the communication providing means (4) comprise a ball (27) configured to be received in the secondary container (3), the ball (27) being sized to plug the hole (26) of the secondary container (3), and the communication providing means (4) also comprise a rod (31) protruding into the beverage receiving cavity (10) of the main container (2) up to the open position, the rod (31) being sized such that when the secondary container (3) is between the open position and the lower position, the rod (31) extends into the hole (26) without plugging the hole and pushes the ball (27), preventing the ball (27) from plugging the hole (26) of the secondary container (3) and thus enabling the communication between the secondary container (3) and the main container (2), and wherein the lower portion (2') carries the rod (31; 34) of the communication providing means (4; 104).

13. The beverage dispensing device (1; 101) according to claim 3, wherein the communication providing means (4; 104) comprise a single rod (31, 34) and a corresponding single hole (26; 126) of the secondary container (3; 103).

14. The beverage dispensing device (1; 101) according to claim 4, wherein the communication providing means (4; 104) comprise a single rod (31, 34) and a corresponding single hole (26; 126) of the secondary container (3; 103).

15. The beverage dispensing device (1; 101) according to claim 5, wherein the communication providing means (4; 104) comprise a single rod (31, 34) and a corresponding single hole (26; 126) of the secondary container (3; 103).

16. The beverage dispensing device (1; 101) according to claim 2, wherein the secondary container (3; 103) is made of plastic material.

17. The beverage dispensing device (1; 101) according to claim 3, wherein the secondary container (3; 103) is made of plastic material.

18. The beverage dispensing device (1; 101) according to claim 4, wherein the secondary container (3; 103) is made of plastic material.

19. The beverage dispensing device (1; 101) according to claim 5, wherein the secondary container (3; 103) is made of plastic material.

20. The beverage dispensing device (1; 101) according to claim 6, wherein the secondary container (3; 103) is made of plastic material.

* * * * *